United States Patent [19]

Diamond

[11] 4,194,335

[45] Mar. 25, 1980

[54] SINGLE SHEATHING ROOF PANEL

[76] Inventor: John N. Diamond, P.O. Box 93, Malvern, Pa. 19355

[21] Appl. No.: 891,326

[22] Filed: Mar. 29, 1978

Related U.S. Application Data

[63] Continuation-in-part of Ser. No. 858,836, Dec. 8, 1977, abandoned.

[51] Int. Cl.[2] ..... E04D 1/00

[52] U.S. Cl. ..... 52/419; 52/519; 52/540; 52/748

[58] Field of Search ..... 52/416–420, 52/518, 519, 525, 540, 747, 748

[56] References Cited

U.S. PATENT DOCUMENTS

| | | | |
|---|---|---|---|
| 1,776,949 | 9/1930 | Lumbard | 52/540 |
| 2,131,477 | 9/1938 | Kirschbraun | 52/519 X |
| 2,256,435 | 9/1941 | Kraus | 52/540 |
| 2,411,771 | 11/1946 | Beasley | 52/519 |
| 3,505,770 | 4/1970 | Bennett | 52/417 X |
| 3,546,843 | 12/1970 | Luebs | 52/540 |
| 3,624,975 | 12/1971 | Morgan et al. | 52/419 |
| 3,640,044 | 2/1972 | Watts | 52/540 X |
| 3,807,113 | 4/1974 | Turner | 52/546 X |

FOREIGN PATENT DOCUMENTS

| | | | |
|---|---|---|---|
| 598465 | 5/1960 | Canada | 52/420 |

*Primary Examiner*—J. Karl Bell

*Attorney, Agent, or Firm*—Birch, Stewart, Kolasch & Birch

[57] ABSTRACT

A prefabricated weatherproof roofing panel for new construction applicable directly to the roof rafters, or for older house construction where the existing roof and sheathing both need replacement, is described. Such prefabricated panels are complete per se and when applied by a carpenter to the roof rafters provide a completed roof construction without the need of the usual skilled roofing workman. The panels include a substrate of plywood covered with a felt sheet material saturated with asphalt. A plurality of shingle strips are secured to each panel over the felt sheet. The plywood substrates are disposed on the roof in edge-to-edge abutting relationship and the shingles of the respective panels extend over the abutting edges into an interlocking and interweaving relationship. The shingle strips of each panel are incised at there bottom edges to form a plurality of tabs. When placed on the panel of the present invention in a plurality of staggered, off-set courses, the tabs give the appearance of separate, individual shingles.

9 Claims, 9 Drawing Figures

SINGLE SHEATHING ROOF PANEL

BACKGROUND OF THE INVENTION

This is a continuation-in-part of prior Application Ser. No. 858,836, filed Dec. 8, 1977 now abandoned.

FIELD OF THE INVENTION

The present invention relates to a prefabricated roofing panel unit made from plywood, waterproof sheet material, such as asphalt-saturated felt and composition shingle strips all purchased directly from the mill, lumber yard or manufacturer.

DESCRIPTION OF THE PRIOR ART

The prior art conventional slanted or pitched-roof construction is implemented for example, by separately securing panels of half-inch thick plywood, sheets of asphalt-saturated felt and strip shingles to the roof. These are separately purchased usually from three separate sources of supply and transferred from each supply source to the job site. After delivery to the job site the panels of plywood are sawed into sections for proper size and affixed to the roof rafters. Then the felt sheets are cut to size and secured to the plywood and finally the strip shingles are suitably applied to the felt covered plywood as the final step to form a weatherproof layer.

Obviously this conventional roofing system requires several experts in the roofing trade to perform a completed installation.

Many attempts have been made in the prior art to prefabricate roofing panels to eliminate the need for the conventional form of assembly described hereinbefore. However, each of these prior art attempts has suffered from certain disadvantages and fallen far short of results achieved by the prefabricated panels of the present invention. For example, one such prefabricated roofing panel is described in U.S. Pat. No. 1,776,949 to Lumbard. The Lumbard panel is similar in appearance at first blush to the panel of the present invention but illustrates a waste of sheathing, namely, each shingle has its own sheathing rather than a plurality of shingles being affixed to a single sheathing panel. In addition, Lumbard's panel became outdated with the introduction of self-sealing shingles, since Lumbard's major purpose in affixing shingles to the sheathing was to prevent the shingles from blowing off the roof.

In the same vein the appearance of the panels of U.S. Pat. Nos. 3,505,770 to Bennett and 3,807,113 to Turner is that of a random abuttment arrangement of shingles whereas the panel of the present invention is layed out in a straight-line course.

The panel of U.S. Pat. No. 3,546,843 to Luebs has a somewhat similar appearance to that of the present invention, but like Lumbard, Luebs employs the overlapping of sheathing so that the roof is in effect single-shingled and double-sheathed.

The most significant deficiency of all of the above prior art references of record is that the panel construction therein does not allow for the panel to be secured to the roof rafters throughout any part of its surface area. These panels allow for only the peripheral fastening around the edges of the panels to the roof rafters or along one definite line of fastening usually at a midlongitudinal point of the panel. In contradistinction, as will become more fully apparent hereinafter the panel of the present invention allows for fastening at any point simply by lifting any single tab on its surface area. The plurality of tabs are not sealed one to the other until the panels have been installed and exposed to the sun. Even then, there is the flexibility of separating and resealing the tab at any time thereafter.

Also, none of the existing prior art allows for reroofing without the dismantling of worn out panels and replacement of the same while the panels of the present invention are designed primarily for new construction, directly on the roof rafters, or for older homes where the existing roof and sheathing both need replacing. Otherwise, once the panels of the present invention have run their service lifetime of fifteen to twenty years, the panels can still be reroofed by applying individual strip shingles directly over the panels without replacing the sheathing. This gives a standard lifetime to the panels of the present invention of from forty-five to sixty years.

SUMMARY OF THE INVENTION

Accordingly, it is an object of the present invention to prefabricate a complete roof panel as a unit, so it may be purchased as a composite unit from one source of supply and then transferred to a jobsite and be lifted and applied by a carpenter to the roof rafters of a house structure.

Another object is to so shape and so form the prefabricated units that the underlay of plywood and felt sheathing of the panel is offset at selected edges with respect to the shingles and arranged in abutting relation to the frame structure of the house and with respect to each other on the roofing rafters.

Another object is to provide a novel system in a prefabricated panel of applying thereto the top weatherproof shingle strips, whereby the underlay felt covered plywood panels are easily fastened to the roof rafters at any point in situ simply and quickly by lifting any single tab of a shingle strip to expose the surface area of the rafter secured underlay for the driving therethrough of a suitable fastener, such as a staple or nail.

Yet another object and feature of the present invention is the formation of an interlocking and/or interweaving of the side edges of the respective shingle strips applied in lapping courses to the underlay panels secured in abutting relation with respect to each other and each respective roof rafter, to thereby present a coupled weatherproof interfit of the shingle side edges for each contiguous adjacent shingle strips of each unit.

BRIEF DESCRIPTION OF THE DRAWINGS

The foregoing and other advantages and objects of this invention will become more clearly understood by reference to the drawings wherein.

DETAILED DESCRIPTION OF DRAWINGS

Figure 1:
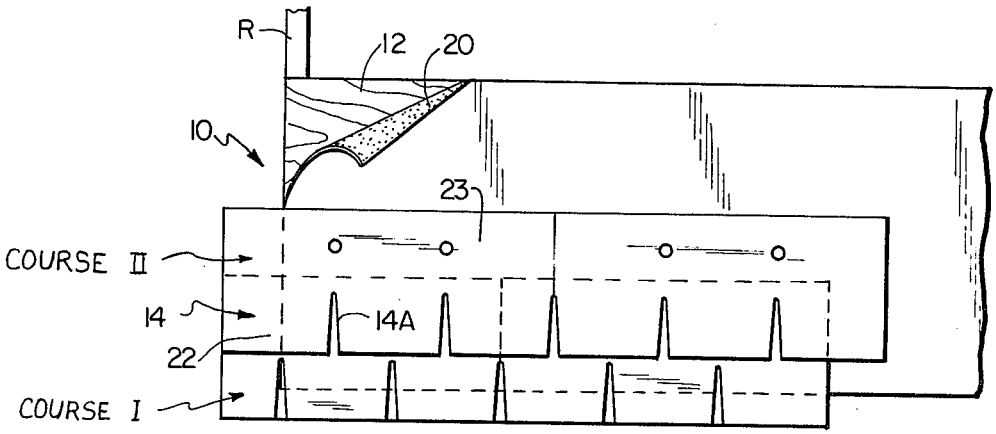
FIG. 1 is a partial top plan view of a roofing panel according to the present invention with some of the respective shingle strips applied.
Figure 2:
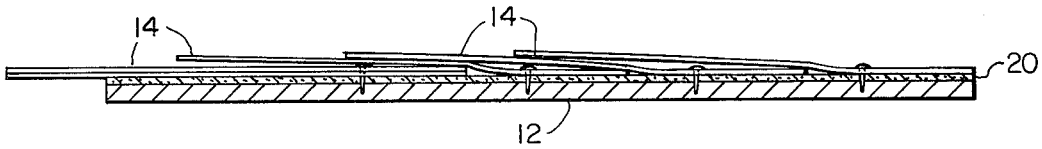
FIG. 2 is a side view in section of a roofing panel according to the present invention.

Referring to the drawings, first with reference to FIGS. 1 and 2, there is shown a preferred embodiment of my invention. This embodiment consists of a prefabricated structure 10 comprising an underlay panel, such as a plywood panel 12 coated with asphalt saturated felt 20 and a plurality of shingle strips 14 incised as at 14A to form tabs 22. These shingle strips 14 when systematically arranged and secured to the underlay panel give the appearance of a roof construction with a plurality of separate shingles of the size of tabs 22 defined by the spacing of incisions 14A.

In preferred shingle strips 14 are one (1) foot wide by three (3) feet long and incisions 14A are equally spaced one (1) foot apart.

The prefabricated roofing panels 10 of the present invention are made in advance away from the site of any building structures to be covered with a roof. For example, the panels may be made in a factory from a standard size of plywood to provide any suitable or desired size, such as from a 4'×8' sheet of ½" plywood cut into two 2'×8' pieces. The felt saturated asphalt sheets 20 and the 1'×3' shingle strips 14 are then secured to these 2'×8' panels to form a complete prefabricated roofing panel in the factory. These completed pre-fab panels 10 may then be transported to the jobsite and applied and secured to the roof rafters R of a building, see FIG. 3.

Each of the plywood pieces 12 are fabricated by laying the same lengthwise and then suitably applying a plurality of courses of the relatively smaller strips of shingles 14 in a terraced or shingle lapped formation to the relatively larger exposed surface of the respective plywood pieces 12 by nailing or stapling the unincised upper elongated straight edges 23 of the shingles thereto. Each shingle sheet or strip 14 is secured along the upper longitudinal edge 23 only, so that the incised lower shingle tab portions 22 of each shingle sheet are not secured to the plywood base piece 12. Thus, each tab shingle section laps freely over its lower contiguous section of a shingle strip 14.

As illustrated in FIG. 1, the shingle strips of each respective course are offset to obtain the overall appearance of a conventional roof with individual shingles. For example, the lower "course I" of shingles, as viewed in FIG. 1, begins at the lower left-hand portion of the drawing (the edge of the roof) with a shingle strip 14 consisting of approximately two and one-half individual shingle tabs 22. The next adjacent shingle strip in "course I" is a full shingle strip including three tabs 22. In the next "course II" the first shingle strip on the left side edge of the roof is also a full shingle strip, as well as the adjacent shingle strip in "course II". Thus, it can be seen that the incisions 14A and the edges of the tabs 22 are staggered between adjacent courses to develop the appearance of a conventional roof with individual shingles. "Course III" of the panel (not shown) would be identical to "course I" and thus staggered or offset with respect to "course II" and so forth with the remaining courses.

To achieve flexibility in the construction of any given roof of any given dimensions it is contemplated to manufacture the roofing panels 10 in different dimensions with some differences in characteristics. For example, a full panel can be chosen or selected to be two feet by eight feet while a half panel of two feet by four feet can also be provided.

This cuts down on material waste in the following manner. Suppose a roof is 26' wide making a course across the roof twenty-six feet. To cover this course on would use three eight foot panels and one four foot panel with two feet of waste in the four foot panel. If only eight foot panels were available, there would be six feet of waste.

Figure 3:
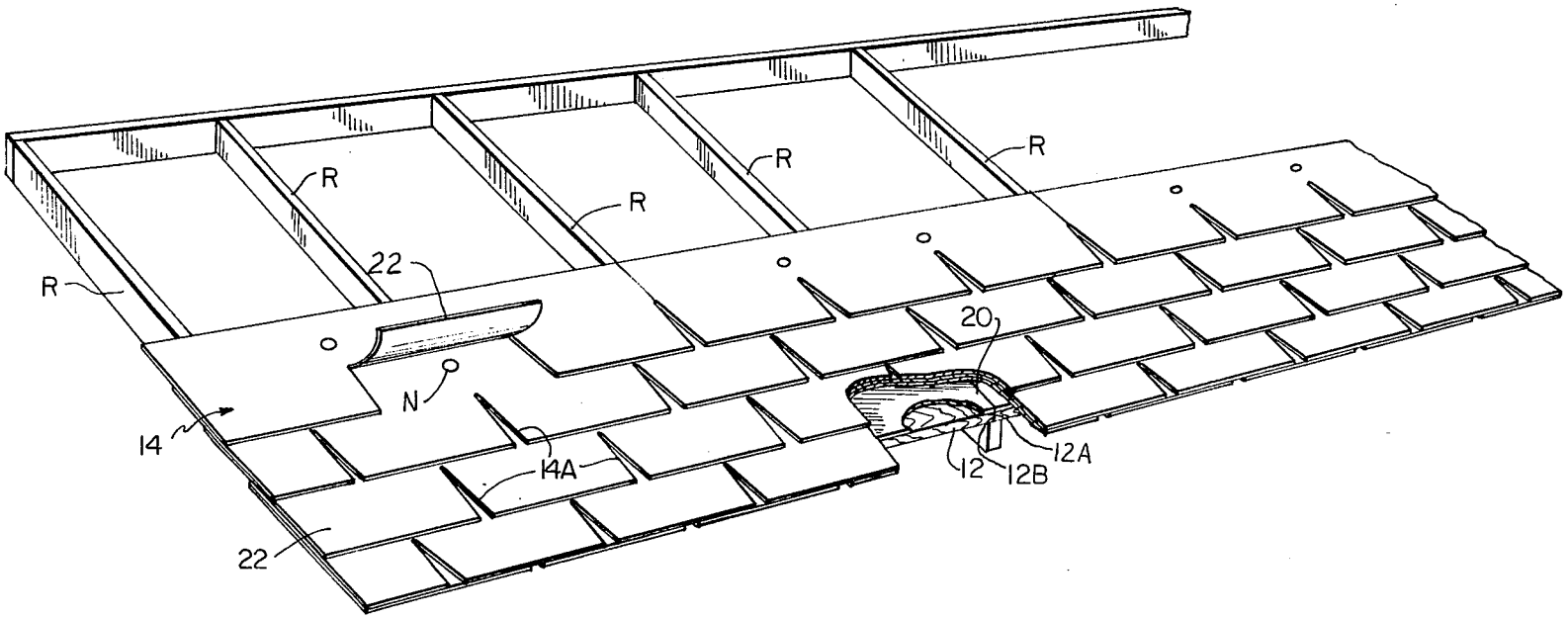
FIG. 3 is a perspective view of a portion of the rafters of a building roof to illustrate the abutting relationship of side panel edges of contiguously adjacent panels and showing a shingle tab raised to illustrate how a portion of the underpanel may be exposed for fastening to the roof rafters.

It is also preferred in practicing the present invention to have the shingles overlap all edges of the roof (the sides and bottom). This is illustrated in FIGS. 1 and 3 viewed together. As illustrated therein the shingles hang over the facia strip or bottom of the roof by approximately 1½ inches and over the side edge of the roof by approximately 5 inches. However, it is important to note that only the shingles hang over the roof edges. The plywood sheets 12 are installed flush with the edges of the roof. This makes it easier to trim the portions hanging over the roof edges since one must only trim the shingles per se and not the plywood.

Referring in detail to FIG. 3 there is illustrated other significant features of the present invention. As shown therein one shingle tab 22 is raised to illustrate how a roofing panel 10 may be nailed or stapled at positions N other than the peripheral edges to the roof rafters R. This is made possible by the use of self sealing shingles and by the construction of the present invention, whereby only the top portions 23 of each of the shingle strips 30 are secured to plywood panels 12. A selected shingle tab 22, as illustrated in FIG. 3 may be raised, a nail or staple driven through panel 10 at that point, and the shingle tab 22 may be placed back down flush with the roof surface. Due to the self sealing nature of shingles 14 when exposed to the heat of the sun, the shingles will form a liquid tight seal over the areas where the nails or staples are applied.

FIG. 3 also illustrates in the region where the shingles are cut away how the respective edges of the underlying plywood sheets at 12A, 12B abutt, while the shingles thereon overlap and interweave over the abutted edges.

Figure 4A:
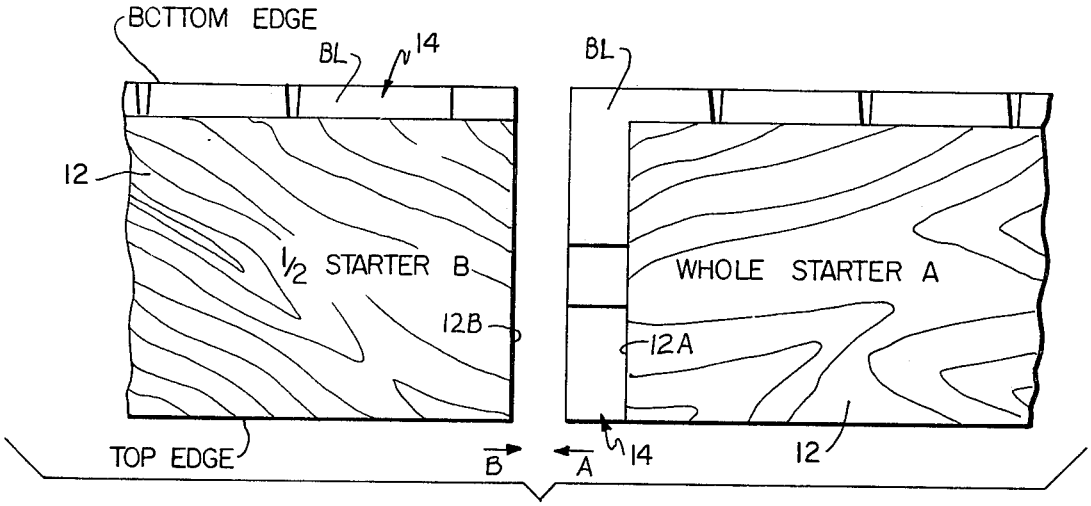
FIG. 4A is a bottom exploded view of a pair of interlocking and interwoven starter roofing panels according to the present invention.

This can be better illustrated in FIG. 4A which is an exploded view from the underside of two roof panels which are to be pushed together into interlocking, interwoven relationship along edges 12A, 12B. The two panels in FIG. 4A may be referred to as starter panels, "starter B" and "starter A" which comprise the first course of panels on the roof of FIG. 3. In FIG. 4 they are flipped over and inverted with respect to FIG. 3. Therefore, FIG. 4A illustrates the underside of the panels of FIG. 3 with the top and bottom edges inverted as indicated.

It should be understood that the panels of the present invention are to be secured to the rafters R of FIG. 3 in courses, not to be confused with the courses of shingles on each panel. For example, one course of starter panels is illustrated in FIG. 3 and successive filler courses will be provided above the course indicated. The panels of these successive courses will have shingles on the bottom plywood edges thereof which hang over said edges in lapping relationship with the shingles on the top of the panels below. The shingles will be longitudinally disposed on the panels such that the incisions 14A between adjacent courses of shingles on the same or adjacent panel are staggered to give the overall appearance of the roof of FIG. 3.

In order to achieve the necessary interlocking, interwoven relationship of the shingles across the abutted ends of the respective panels, a preferred embodiment of the present invention provides a kit of two to six types of panels. This kit includes starter panels, types A and B, and filler panels, types A and B and/or C and D.

Figure 4B:
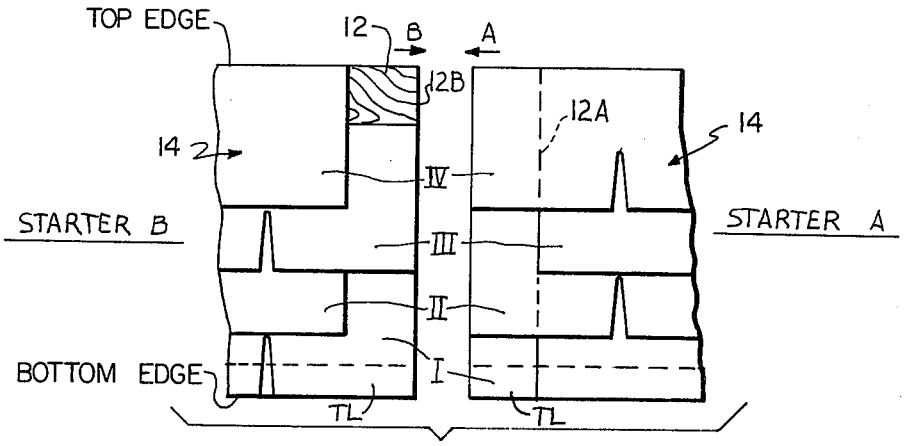
FIG. 4B is a top exploded view of the starter roofing panels of FIG. 4A.

The starter panels, "starter A" and "starter B" are illustrated in FIGS. 4A and 4B from the underside and topside, respectively. It should also be noted, as stated hereinbefore, that the top and bottom edges of these panels are inverted in the two figures to facilitate a better understanding of the details of the construction thereof. The top and bottom edges are appropriately labeled in each Figure.

The starter panels comprise the first course of panels in a roof such as illustrated in FIG. 3. Referring in more detail to FIGS. 4A and 4B the respective panels "starter A" and "starter B" have very specific abutting end configurations which enable the abutting ends 12A, 12B of the panels to interlock and interweave. As illustrated in FIG. 4A from the underside "starter A", shingles 14 of some of the respective courses overlap the end 12A of the panel. On the other hand none of the shingles 14 overlap the end 12B of "starter B". It should be noted that the starter panels A and B both have a double first course of shingles at the bottom edge of the panels which overlap said bottom edge. The bottom layers of this first course of shingles are indicated as BL in FIG. 4A.

Referring to FIG. 4B the top view of "starter A" and "starter B" illustrate that each panel has four courses of shingles 14 labeled I, II, III, and IV. The first course I, as stated hereinbefore has two layers of shingles, the top layer being labeled TL in FIG. 4B.

The end shingles at both ends of the respective courses of the "STARTER A" panel have the following positional relationship to the ends 12A thereof:

Course "I"—The end shingle top layer TL is flush with ends 12A while the bottom layer BL overlaps end 12A by approximately six inches and extends toward 12B.

Course "II"—The end shingle of this course overlaps ends 12A by approximately six inches and extends toward end 12B.

Course "III"—The end shingle of this course is flush with end 12A.

Course "IV"—The end shingle of this course overlaps ends 12A by approximately six inches and extends toward end 12B.

The end shingles at both ends of the respective courses of "starter B" panel have the following relationship to the end 12B thereof:

Course"I"—The end shingle bottom layer BL is indented from the 12B ends by approximately six inches while the top layer TL is flush with ends 12B.

Course "II"—The end shingle of this course is indented by approximately six inches with respect to ends 12B.

Course "III"—The end shingle of this course is flush with ends 12B.

Course "IV"—The end shingle of this course is indented by approximately six inches with respect to ends 12B.

Figure 5A:
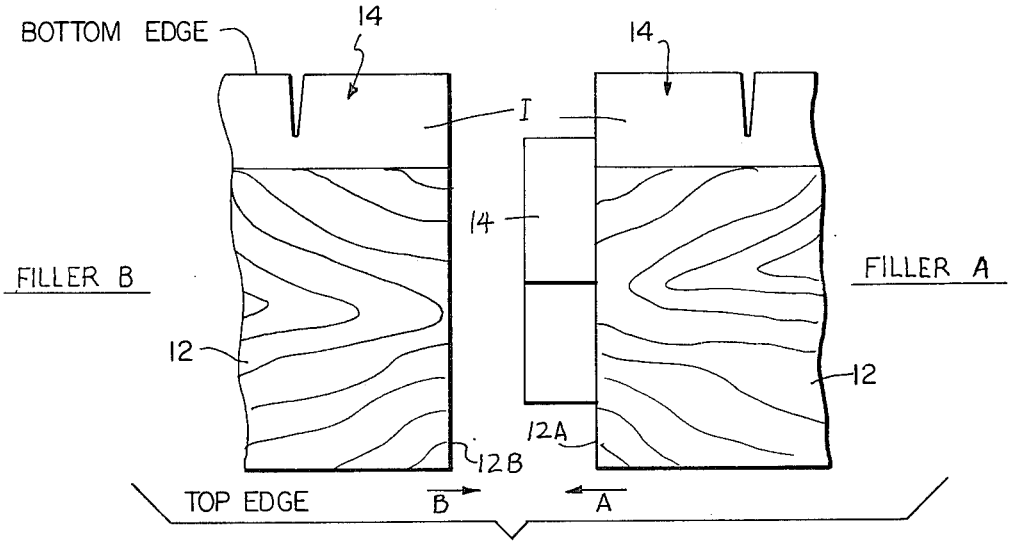
FIG. 5A is a bottom exploded view of a pair of interlocking and interwoven filler roofing panels according to the present invention.
Figure 5B:
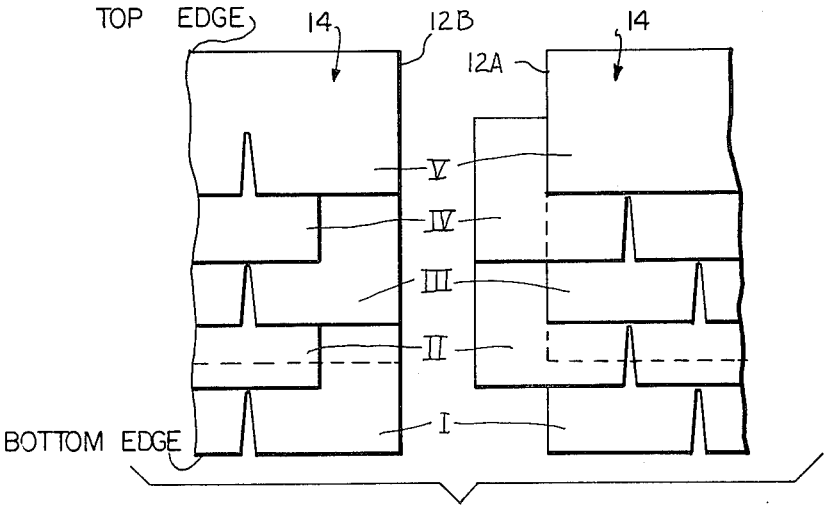
FIG. 5B is a top exploded view of the filler roofing panels of FIG. 5A.

The filler panels types A and B will be referred to hereinafter as "FILLER A" and "FILLER B", respectively, and are illustrated in FIGS. 5A and 5B. FIG. 5A shows the underside of the panels while FIG. 5B shows the topside of the panels. FIGS. 5A and 5B have the top and bottom edges of the respective panels inverted with respect to each other in a similar manner to FIGS. 4A and 4B.

As stated hereinbefore the "FILLER A" and "FILLER B" panels comprise the next course of panels on the roof of FIG. 3 above the starter panels, which for a very small roof may be sufficient to complete the roof. However, in most cases the course of panels following Fillers A and B will consist of alternate abutting Filler panels C and D to be described hereinafter with respect to FIGS. 6 and 7.

Referring in detail to FIG. 5A, as seen from the underside, "FILLER A" panel has some shingles 14 which overlap edge 12A and a first course I which overlaps the bottom edge. On the other hand "FILLER B" has no overlapping shingles with respect to edge 12B and a course I which overlaps the bottom edge. It should be noted that the first course I of the filler panels has only a single layer of shingles and has five courses as viewed from the topside.

Referring in detail to FIG. 5B the end shingles at both ends of the respective courses of "FILLER A" panel have the following positional relationship with respect to the ends 12A:

Course "I"—The end shingle is flush with ends 12A.

Course "II"—The end shingle overlaps end 12A by approximately six inches and extends toward end 12B.

Course "III"—The end shingle is flush with ends 12A.

Course "IV"—The end shingle overlaps ends 12A by approximately six inches and extends toward end 12B.

Course "V"—The end shingle is flush with ends 12A.

Referring in further detail to FIG. 5B the end shingles at both ends of the respective course of "FILLER B" panel have the following positional relationship with respect to ends 12B:

Course"I"—The end shingle is flush with ends 12B.

Course "II"—The end shingle is indented with respect to ends 12B by approximately six inches.

Course "III"—The end shingle is flush with respect to ends 12B.

Course "IV"—The end shingle is indented with respect to ends 12B by approximately six inches.

Course "V"—The end shingle is flush with ends 12B.

Figure 6:
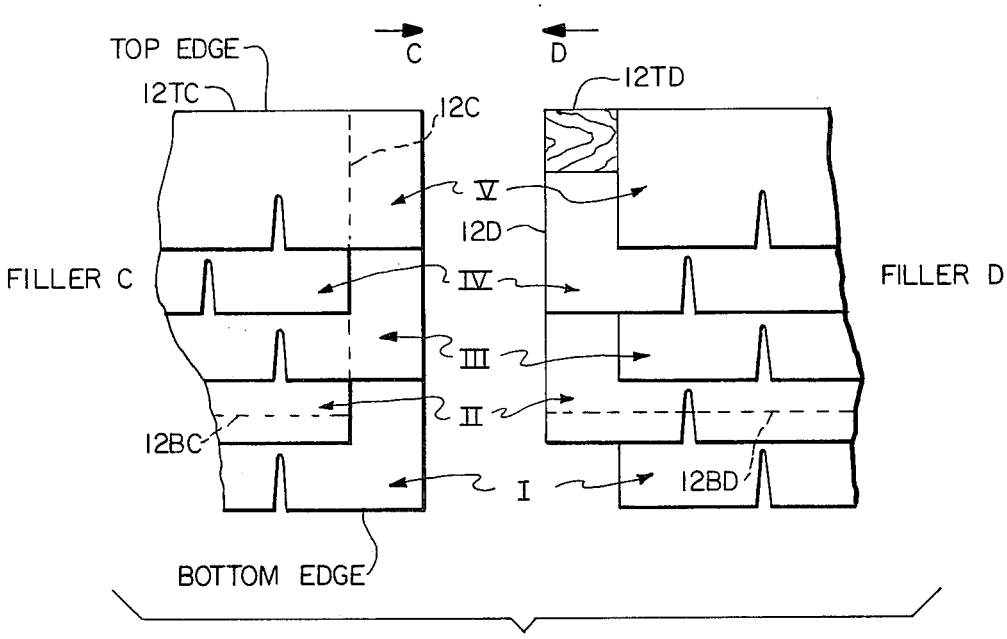
FIG. 6 is a top plan view of additional filler roofing panels according to the present invention.

Referring in detail to FIG. 6 there is illustrated a top plan view of additional filler roofing panels to be referred to hereinafter as "FILLER C" and "FILLER D" from the top side of the panel. The bottom view of panel "FILLER C" and "FILLER D" are not shown for the sake of simplicity.

Referring in further detail to FIG. 6 the end shingles at both ends of the respective couses of "FILLER C" panel have the following positional relationship with respect to ends 12C thereof:

Course "I"—The end shingle overlaps ends 12C by approximately six (6) inches.

Course "II"—The end shingle is flush with ends 12C.

Course "III"—The end shingle overlaps ends 12C by approximately six (6) inches.

Course "IV"—The end shingle is flush with ends 12C.

Course "V"—The end shingle overlaps ends 12C by approximately six (6) inches.

Referring in further detail to FIG. 6 the end shingle at both ends of the respective courses of "FILLER D" panel have the following positional relationships with respect to end 12B thereof:

Course "I"—The end shingle is indented approximately six (6) inches from ends 12D.

Course "II"—The end shingle is flush with ends 12D.

Course "II"—The end shingle is indented approximately six (6) inches with respect to ends 12D.

Course "IV"—The end shingle is flush with ends 12D.

Course "V"—The end shingle is indented approximately six (6) inches with respect to ends 12D.

It should be understood that the description of FIGS. 4A, 4B, 5A, 5B and 6 primarily define the abutting end configurations of the respective panels of the kit whereby plywood ends 12A, 12B, 12C and 12D are butted together and the respective shingles of panels A, B, C and D interlock and interweave. Panels of type A and type B are always butted together A to B or B to A laterally of the roof in each respective course of panels as indicated by the directional arrows in FIGS. 4A, 4B, 5A and 5B. Likewise panels of type C and D are butted together C to D or D to C.

The lower course I of shingles of the filler panels A and B overlap the upper course IV of the starter panels when placed on a roof and the incisions 14A are staggered or alternate between adjacent courses of adjacent panels. The next successive course of filler panels C and D would have its lower course of shingles in overlapping and staggered relation with the upper course of shingles of the filler panel course therebelow and so forth.

Figure 7:
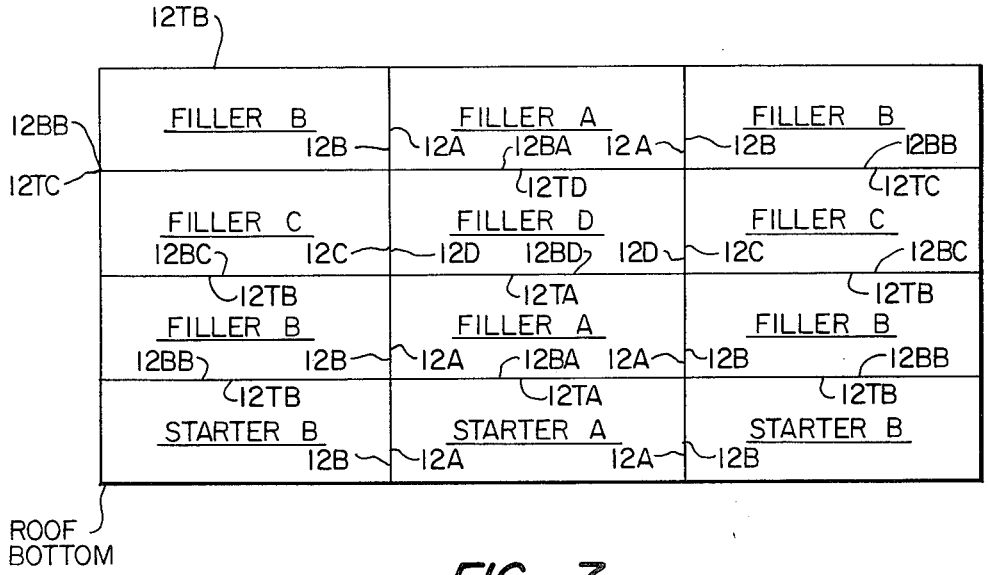
FIG. 7 is a diagrammatic view illustrating the modular assembly of the roofing panels of the present invention.

This is best illustrated by reference to FIG. 7 which illustrates in diagramatic form the interwoven and overlapping relationship of 12 roofing panels of the present invention as they would be applied to a roof section measuring 8'×24', each of the panels being 2' wide (high) and 8' long. As illustrated in FIG. 7, the first course of panels (not to be confused with the first course of shingles) consists of a "STARTER B" panel, a "STARTER A" panel and a "STARTER B" panel, alternately disposed on the roof rafters such that ends 12A, 12B of the plywood underlayment portion of the panel are in butting relationship as shown. The next course of panels consists of "FILLER B", "FILLER A", and "FILLER B" also disposed in alternating abutting relationship so that the ends of plywood underlayment 12A, 12B butt together. As can be seen, "FILLER B" panels are always stacked on top of "STARTER B" panels, and "FILLER A" panels are always on top of "STARTER A" panels, so that the incised portions 14A of the shingles referred to hereinbefore and illustrated in the drawings are in alternate staggered relation between each adjacent course of shingles whether on the same or different panels of the modular roof construction of the present invention. Likewise, in order to achieve this alternate staggered relationship of the incised portions 14A on filler panels "FILLER C" and "FILLER D", "FILLER C" is always stacked on top of "FILLER B" panels and "FILLER D" panels must always be stacked on top of "FILLER A" panels and vice versa. This is illustrated in FIG. 7 which shows bottom edge 12BC of "FILLER C" panels abutting top edge 12TB of "FILLER B" panel and bottom edge 12BD of "FILLER D" panel butting against top edge 12BA of "FILLER A" panel in forming the third course of roofing panel. As illustrated to form the fourth course of the roofing panel "FILLER B" is stacked on top of "FILLER C" and "FILLER A" on top of "FILLER D", and so on in alternation until the peak of the roof is reached.

Thus, as can be seen from FIG. 7 applicant has invented an innovative arrangement of interleaving and interwoven roofing panel with specific characteristic end configurations of the shingles with respect to the end of the panels which facilitate the modular construction of a roof of any desired size.

It should be noted that if desired the starter panels of FIG. 7 can be eliminated and only filler panels A, B, C and D used to construct a roof. If this is done the bottom shingles of the first course of panels can be trimmed off to any desired extent to provide for example a two and one-half inch overlap at the bottom of the roof.

It should be further understood that the panels of the present invention may be modified as would occur to one of ordinary skill in the art without departing from the spirit and scope of the present invention.

For example, the felt layer 20 may be eliminated if desired or in the alternative aluminum foil, insulating board, or foam panels may be used in its place.

What is claimed is:

1. A kit of prefabricated panels for roof construction including only four panels, said panels having characteristic end configurations designed to achieve an interlocking and interwoven relationship of shingles at the ends of selected panels which are butted together on a roof and a staggered overlapping relationship between the shingles on adjacent top and bottom edges when said panels are positioned in a vertical array of panel courses on a roof, said shingles of said panels including strips with upper straight edges along which said strips are secured to base sheets of said panels and lower incised unsecured edges in the provision of a plurality of unsecured liftable tabs, said shingle strips being self-sealing, one to the other in response to the heat of the sun comprising:

a base sheet for each of said four panels having at least one end to be butted against a selected said at least one end of another panel;

a first panel having four courses of shingles thereon extending longitudinally of said panel, said courses overlapping adjacent courses transversely of said panel, a first course of said shingles having a top layer of shingles and a bottom layer of shingles, the end shingles of the respective courses having a predetermined characteristic positional relationship to said at least one end of said base sheet wherein, the end shingle of said top layer of said first course is flush with said at least one end while the bottom layer overlaps said at least one end, the end shingle of a second course overlaps said at least one end, the end shingle of a third course is flush with said at least one end, and the end shingle of a fourth course overlaps said at least one end;

a second panel having four courses of shingles thereon extending longitudinally of said panel, said courses overlapping adjacent courses transversely of said panel, a first course of said shingles having a top layer of shingles and a bottom layer of shingles, the end shingles of the respective courses having a predetermined characteristic positional relationship to said at least one end of said base sheet wherein, the end shingle of said top layer of said first course is flush with said at least one end while the end shingle of said bottom layer is indented inwardly of the panel from said at least one end, the end shingle of a second course is indented inwardly of the panel from said at least one end, the end shingle of a third course is flush with said at least one end, and the end shingle of a fourth course is indented inwardly of the panel from said at least one end;

a third panel having five courses of shingles thereon extending longitudinally of said panel, said courses overlapping adjacent courses transversely of said panel, the end shingles of the respective courses having a predetermined characteristic positional relationship to said at least one end of said base sheet wherein, the end shingle of a first course is flush with said at least one end, the end shingle of a second course overlaps said at least one end, the end shingle of a third course is flush with said at least one end, the end shingle of a fourth course overlaps said at least one end, and the end shingle of a fifth course is flush with said at least one end;

a fourth panel having five courses of shingles thereon extending longitudinally of said panel, said courses overlapping adjacent courses transversely of said panel, the end shingles of the respective courses having a predetermined characteristic positional relationship to said at least one end of said base sheet wherein, the end shingle of a first course is flush with said at least one end, the end shingle of a second course is indented inwardly of the panel with respect to said at least one end, the end shingle of a third course is flush with said at least one end, the end shingle of a fourth course is indented inwardly of the panel with respect to said at least one end, and the end shingle of a fifth course is flush with said at least one end.

2. A kit of prefabricated panels according to claim 1 wherein each of said plywood panels is covered with a layer of felt saturated with asphalt.

3. A kit of prefabricated panels according to claim 1 wherein each of said plywood panels is covered with a layer of metal foil.

4. A kit of prefabricated panels according to claim 1 wherein each of said plywood panels is covered with a layer of heat insulating material.

5. A kit of prefabricated panels for roof construction including, only six panels, said panels having characteristic end configurations designed to achieve an interlocking and interwoven relationship of shingles at the ends of selected panels which are butted together on a roof and a staggered overlapping relationship between the shingles on adjacent top and bottom edges when said panels are positioned in a vertical array of panel courses on a roof, said shingles of said panels including strips with upper straight edges along which said strips are secured to base sheets of said panels and lower incised unsecured edges in the provision of a plurality of unsecured liftable tabs, said shingle strips being self-sealing, one to the other in response to the heat of the sun comprising:

a base sheet for each of said six panels having at least on end to be butted against a selected said at least one end of another panel;

a first panel having four coursed of shingles thereon extending longitudinally of said panel, said courses overlapping adjacent courses transversely of said panel, a first course of said shingles having a top layer of shingles and a bottom layer of shingles, the end shingles of the respective courses having a predetermined characteristic positional relationship to said at least one end of said base sheet wherein, the end shingle of said top layer of said first course is flush with said at least one end while the bottom layer overlaps said at least one end, the end shingle of a second course overlaps said at least one end, the end shingle of a third course is flush with said at least one end, and the end shingle of a fourth course overlaps said at least one end;

a second panel having four courses of shingles thereon extending longitudinally of said panel, said courses overlapping adjacent courses transversely of said panel, a first course of said shingles having a top layer of shingles and a bottom layer of shingles, the end shingles of the respective courses having a predetermined characteristic positional relationship to said at least one end of said base sheet wherein, the end shingle of said top layer of said first course is flush with said at least one end while the end shingle of said bottom layer is indented inwardly of the panel from said at least one end, the end shingle of a second course is indented inwardly of the panel from said at least one end, the end shingle of a third course is flush with said at least one end, and the end shingle of a fourth course is indented inwardly of the panel from said at least one end;

a third panel having five courses of shingles thereon extending longitudinally of said panel, said courses overlapping adjacent courses transversely of said panel, the end shingles of the respective courses having a predetermined characteristic positional relationship to said at least one end of said base sheet wherein, the end shingle of a first course is flush with said at least one end, the end shingle of a second course overlaps said at least one end, the end shingle of a third course is flush with said at least one end, the end shingle of a fourth course overlaps said at least one end, and the end shingle of a fifth course is flush with said at least one end;

a fourth panel having five courses of shingles thereon extending longitudinally of said panel, said courses overlapping adjacent courses transversely of said panel, the end shingles of the respective courses having a predetermined characteristic positional relationship to said at least one end of said base sheet wherein, the end shingle of a first course is flush with said at least one end, the end shingle of a second course is indented inwardly of the panel with respect to said at least one end, the end shingle of a third course is flush with said at least one end, the end shingle of a fourth course is indented inwardly of the panel with respect to said at least one end, and the end shingle of a fifth course is flush with said at least one end;

a fifth panel having five courses of shingles thereon extending longitudinally of said panel, said courses overlapping adjacent courses transversely of said panel, the end shingles of the respective courses having a predetermined characteristic positional relationship to said at least one end of said base sheet wherein, the end shingle of a first course overlaps said at least one end, the end shingle of a second course is flush with said at least one end, the end shingle of a third course overlaps said at least one end, the end shingle of a fourth course is flush with at least one end, and the end shingle of a fifth course overlaps said at least one end;

a sixth panel having five courses of shingles thereon extending longitudinally of said panel, said courses overlapping adjacent courses transversely of said panel, the end shingles of the respective courses having a predetermined characteristic positional relationship to said at least one end of said base sheet wherein, the end shingle of a first course is indented inwardly of the panel with respect to said at least one end, the end shingle of a second course is flush with respect to said at least one end, the end shingle of a third course is indented inwardly of the panel with respect to said at least one end, the end shingle of a fourth course is flush with respect to said at least one end, and the end shingle of a fifth course is indented inwardly of the panel with respect to said at least one end.

6. A kit of prefabricated panels according to claim 5, wherein each of said plywood panels is covered with a layer of felt saturated with asphalt.

7. A kit of prefabricated panels according to claim 5, wherein each of said plywood panels is covered with a layer of metal foil.

8. A kit of prefabricated panels according to claim 5, wherein each of said plywood panels is covered with a layer of heat insulating material.

9. A kit of prefabricated roofing panels comprising:

a plurality of base sheets of the same predetermined dimensions, one base sheet being provided for each of said roofing panels;

a plurality of roofing shingle strips disposed in five courses on each of said base sheets, said roofing shingle strips being self sealing one to the other in response to the heat of the sun and having upper straight edges along which said strips are secured to said base sheets and lower unsecured edges in the provision of a plurality of liftable tabs of substantially the same dimensions, the shingle strips of each of said courses being offset so that said tabs of the shingle strips from the respective courses are offset in the longitudinal direction of said courses with respect to the tabs in adjacent courses:

each of said roofing panels having end edges adapted for abutting an end edge of another panel in an aligned course of panels;

each of said end edges of said roofing panels having characteristic end edge configurations designed to achieve an interlocking and interwoven relationship of shingles at the ends of selected panels which are abutted together on a roof, and a staggered overlapping relationship between the shingles on adjacent top and bottom edges when said panels are positioned in a vertical array of panel courses on a roof, said end edge configurations being of only four different types including;

a first type of end configuration wherein the end shingles of the respective five courses of shingles have a predetermined characteristic positional relationship to the associated end of a given panel wherein, the end shingle of a first course is flush with said at least one end, the end shingle of a second course overlaps said at least one end, the end shingle of a third course is flush with said at least one end, the end shingle of a fourth course overlaps said at least one end, and the end shingle of a fifth course is flush with said at least one end;

a second type of end configuration wherein the end shingles of the respective five courses of shingles have a predetermined characteristic positional relationship to the associated end of a given panel wherein, the end shingle of a first course if flush with said at least one end, the end shingle of a second course is indented inwardly of the panel with respect to said at least one end, the end shingle of a third course is flush with said at least one end, the end shingle of a fourth course is indented inwardly of the panel with respect to said at least one end, and the end shingle of a fifth course is flush with said at least one end;

a third type of end configuration wherein the end shingles of the respective five courses of shingles have a predetermined characteristic positional relationship to the associated end of a given panel wherein, the end shingle of a first course overlaps said at least one end, the end shingle of a second course is flush with said at least one end, the end shingle of a third course overlaps said at least one end, the end shingle of a fourth course is flush with at least one end, and the end shingle of a fifth course overlaps said at least one end;

a fourth type of end configuration wherein the end shingles of the respective five courses of shingles have a predetermined characteristic positional relationship to the associated end of a given panel wherein, the end shingle of a first course is indented inwardly of the panel with respect to said at least one end, the end shingle of a second course is flush with respect to said at least one end, the end shingle of a third course is indented inwardly of the panel with respect to said at least one end, the end shingle of a fourth course is flush with respect to said at least one end, and the end shingle of a fifth course is indented inwardly of the panel with respect to said at least one end.

* * * * *